United States Patent [19]

Spiegel

[11] 4,097,099

[45] Jun. 27, 1978

[54] DISHWASHER RACK SUPPORTING AND ADJUSTING APPARATUS

[75] Inventor: Raymond William Spiegel, Stevensville, Mich.

[73] Assignee: Whirlpool Corporation, Benton Harbor, Mich.

[21] Appl. No.: 756,531

[22] Filed: Dec. 29, 1976

[51] Int. Cl.[2] ..... A47B 88/00; A47B 95/00

[52] U.S. Cl. ..... 312/311; 312/351; 312/312

[58] Field of Search ..... 312/303, 311, 312, 330, 312/351; 108/147; 211/176; 297/338, 345

[56] References Cited

U.S. PATENT DOCUMENTS

| | | | |
|---|---|---|---|
| 3,734,589 | 5/1973 | Morgan | 312/351 |
| 3,768,883 | 10/1973 | Kauffman | 321/351 |
| 3,809,450 | 5/1974 | Guth | 312/351 |
| 3,809,451 | 5/1974 | Pitstick | 312/351 |
| 3,822,085 | 7/1974 | Clark | 312/351 |

*Primary Examiner*—Casmir A. Nunberg

*Attorney, Agent, or Firm*—Wegner, Stellman, McCord, Wiles & Wood

[57] ABSTRACT

A supporting and adjusting apparatus for vertically positioning an open dishrack in a dishwasher particularly of the type where the dishrack is projected outwardly of the cabinet for loading and unloading in which there are provided a pair of housings mounted on opposite sides of the dishrack with each housing having a pair of arms extending in tandem and located adjacent to the corresponding side of the dishrack. Each arm is mounted on a fulcrum and carries a wheel on the end extending from the housing so that on each side of the dishrack there are a pair of wheels engaging a supporting guide track that forms a part of the dishwasher with the tracks being projected outwardly when projecting the dishrack outwardly for loading and unloading. Each housing encloses worm wheel sector gears on the arms and a corresponding single worm gear engaging the sector gears for adjusting the arms about their fulcrums and thereby adjusting the vertical position of the dishrack.

10 Claims, 6 Drawing Figures

Fig. 1
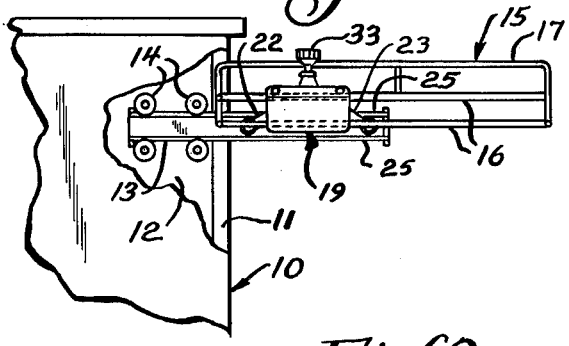
Fig. 2
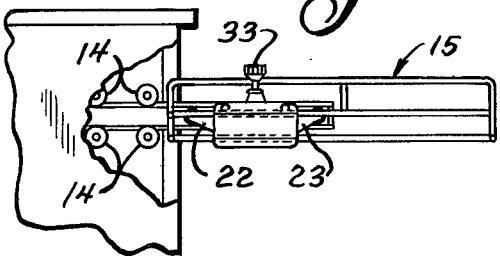
Fig. 3
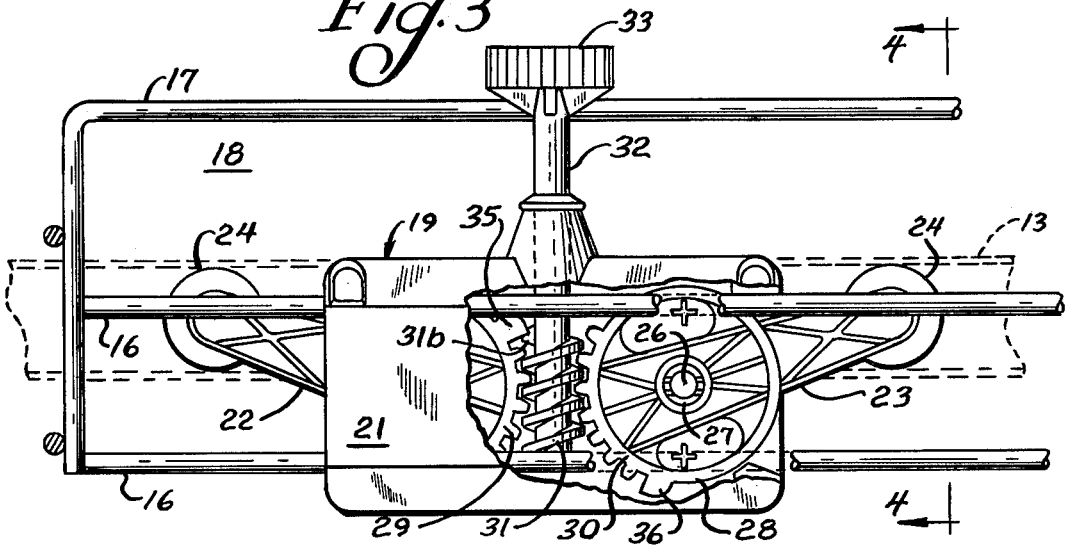
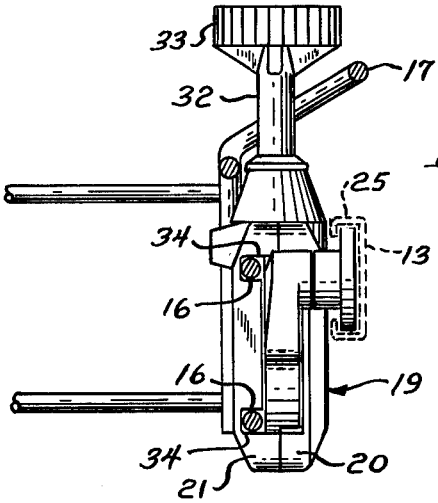
Fig. 4

DISHWASHER RACK SUPPORTING AND ADJUSTING APPARATUS

BACKGROUND OF THE INVENTION

1. Field of the Invention

This invention relates to a dishrack supporting and adjusting apparatus for a dishwasher in which improved means are provided for supporting each side of the dishrack and for adjusting the support relative to the dishrack to accommodate articles of varying heights in the dishwasher.

2. Description of the Prior Art

In preparing the application, the following U.S. patents were considered: U.S. Pat. Nos. 3,269,548; 3,472,573; 3,614,187; 3,734,589; 3,768,883; 3,809,450; 3,809,451, and 3,822,085. These disclose various adjusting mechanisms for adjusting the position of a dishrack but none of them discloses the invention as claimed herein.

SUMMARY OF THE INVENTION

The dishrack supporting and adjusting apparatus of this invention includes an enclosing housing on each side of the rack formed of separable parts embracing the sides of the rack with each housing mounting a pair of arms extending forwardly and rearwardly of the corresponding side of the rack and close to the side and each carrying a supporting wheel, or roller, so that the two wheels on each side of the rack are in tandem. In order to provide for adjusting the position of the wheels, the ends of the arms within the housing are formed as arcuate worm wheel sectors each concentric with the fulcrum axis of its arm and with the two sector gears on each side of the dishrack being spaced apart a distance sufficient to provide for a worm gear located between the sectors and engaging gear teeth on both. Each worm gear has an end externally of the housing and provided with a hand engageable knob for rotating the worm and thereby moving the sector gears to move arcuately the arms simultaneously on each side about their fulcrums.

The parts are so proportioned that the rollers are preferably horizontally aligned in all adjusted positions of the arms on a side of the rack in the preferred construction and in an especially preferred construction, all of the arms, all of the sector gears, all of the worm gears and all of the corresponding housing parts are structurally identical.

In an especially preferred apparatus, each sector gear includes a stop member with these stop members engaging the worm gear at the ends of the desired range of movement of the arms so as to determine this range of movement.

BRIEF DESCRIPTION OF THE DRAWING

Other features and advantages of the invention will be apparent from the following description taken in connection with the accompanying drawing wherein:

FIG. 1 is a fragmentary side elevational view partially broken away for clarity of illustration illustrating a dishwasher with the dishrack in an extended position and including supporting apparatus embodying the invention;

FIG. 2 is a view similar to FIG. 1 but showing the supporting arms and wheels in the opposite adjusted position from that shown in FIG. 1;

FIG. 3 is an enlarged fragmentary sectional view illustrating a portion of the structure in the lowermost adjusted arrangement of the dishrack, with parts broken away for clarity of illustration;

FIG. 4 is a vertical sectional view taken substantially along the line 4—4 of FIG. 3;

DESCRIPTION OF THE PREFERRED EMBODIMENT

Figure 5:
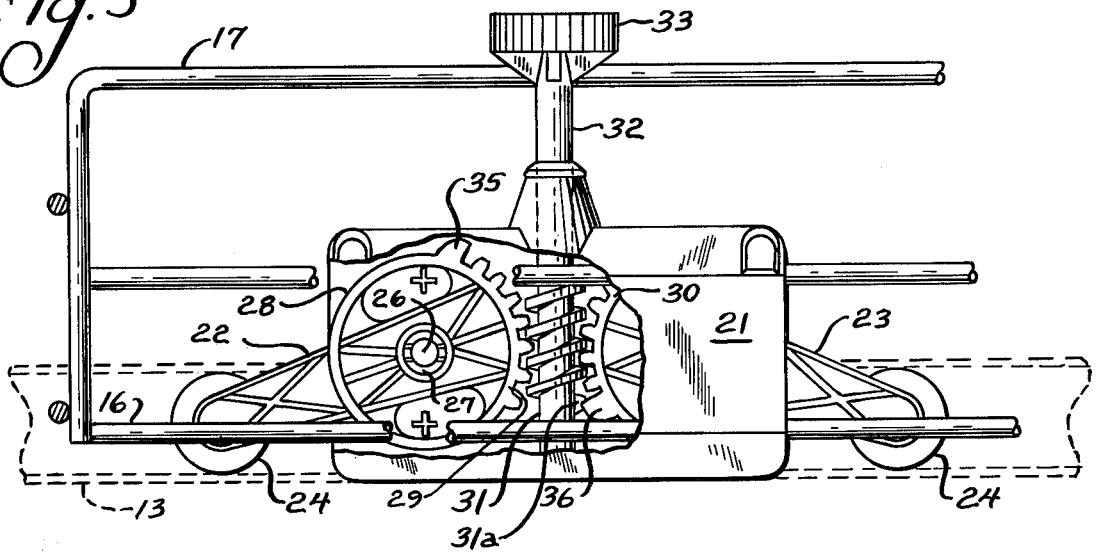
FIG. 5 is an enlarged fragmentary sectional view of the structure of FIG. 3 in the uppermost adjusted arrangement of the dishrack.

In the embodiment illustrated in the drawings, there is provided a dishwasher 10 including an opening 11 at the front normally closed by a door (not shown) that provides access to a tub 12 on each side of which there is provided a supporting guide track 13 that is movably supported as on pairs of upper and lower side rollers 14 mounted on the tub sidewall so that the track can be projected from the tub 12 for loading and unloading a dishrack 15 when the dishrack is in the projected position shown in FIG. 1.

The dishrack 15, in the illustrated embodiment, comprises spaced wires including wires 16 and a top wire 17. The wires 16 and 17 define a side 18 of the dishrack and each side 18 has mounted thereon a housing 19 comprising two separable parts 20 and 21.

Extending forwardly and rearwardly of each housing 19 are a pair of substantially coplanar arms 22 and 23, each carrying on its extended end a roller, or wheel, 24. The result is that the arms 22 and 23 and the wheels 24 are all substantially coplanar and they, with the corresponding housing 19, are located against the side 18 of the dishrack. Each pair of wheels 24 on each side of the dishrack is in tandem, i.e., one behind the other, and maintained supported on its associated track 13 in all positions of the rack. The wheels 24 roll within their guide track 13 in the customary manner so that the four side wheels 24 support the rack for forward and rearward movement and also, by engaging upper and lower flanges 25 of the tracks 13, support the rack against vertical dislodgment and tipping.

Each arm 22 and 23 is mounted for rotation about a fulcrum 27 so as to be arcuately movable about an axis 26 that is concentric with its fulcrum 27. Each arm 22 and 23 has the end that is within the housing 19 comprising a circular flange 28 that is generally concentric with the axis 26 and on an outer peripheral surface of the inner side of this flange, there is integrally formed a worm wheel sector gear 29.

These sector gears are spaced apart, as shown in FIG. 3, a distance substantially equal to the thickness of a worm gear 31. The helical teeth of these worm gears 31 engage the teeth of their sector gears 29 and 30 and each worm gear extends upwardly from its corresponding housing 19 to provide an external stem 32 on the upper end of which is mounted a knob 33 that can be rotated by hand to move both the sector gears 29 and 30 simultaneously and thereby simultaneously adjust the positions of the arms 22 and 23 and of the supporting wheels 24. The two extreme positions of the arms and the wheels are illustrated in FIGS. 1 and 2.

In the illustrated embodiment, each arm 22 and 23 may be constructed integrally with its corresponding sector gear and these integral parts may be substantially identical. These same parts are also identical to those in the opposite supporting apparatus (not shown) on the opposite side of the dishrack.

As can be seen in FIGS. 3 and 4, the two separable parts 20 and 21 of the housing 19 not only enclose the gears and the inner ends of the arms 22 and 23, but also embrace the corresponding side wires 16 so as to support the housing 19 and, thus, the supporting wheels 24. In this embodiment, the arms and the gears are supported primarily by the one housing part 20 while the wires 16 are located in grooves 34 within the other housing part 21 with the result that when the housing parts 20 and 21 are assembled, as shown in FIG. 4, the grooves 34 and, thus, the adjacent portions of wires 16 are enclosed.

The adjustable rack supporting apparatus of this invention operates as follows. Each knob 33 on each side 18 of the dishrack 15 is independently rotatable so as to rotate the corresponding worm gear 31 and move arcuately and simultaneously the corresponding pair of sector gears 29 and 30. This adjusts the position of the arms 22 and 23 in a vertical plane thereby adjusting the height of each pair of supporting wheels 24 with respect to the rack simultaneously so as to maintain the same relative positions each to the other. Since each housing 19 is fixed to dishrack 15, the positions of the supporting wheels 24 with respect to their corresponding housing 19 will, because of their engagement with the side guide tracks 13, determine the vertical position of the dishrack 15. Then, when any adjustments are required as for accommodating dishes or similar articles of different heights within the dishwasher tub, the vertical position of the dishrack 15 is easily changed by turning the two adjusting knobs 33.

The supporting arm 23, being movable to adjusted position by rotating the corresponding worm gear 31, means that the rollers 24 on each side of the rack are independently adjustable to an infinite number of vertical positions within the adjustment range. These arms on each side of the dishrack are movable through a range of movement and the extremes of this range of movement are determined by a pair of stop portions 35 and 36 comprising projections each adjacent one end of the sector gears 29 and 30 with the two stop portions or members 35 and 36 being located opposite to each other. By placing the stop members 35 and 36 at the end of the toothed segments of the cooperating sector gears 29 and 30, the stop member 35 engages a surface 31*b* at the upper end of the worm gear 31 in the extreme downward position of the dishrack, as shown in FIG. 3, while the other stop member 36 engages a surface 31*a* at the lower end of worm gear 31 at the extreme of the range of upward adjustment of the dishrack, as shown in FIG. 5.

As can be seen, the supporting and adjusting mechanism is quite compact and thin so that each can be positioned adjacent to one side of the dishrack as shown and will not interfere with the loading or unloading of the rack or servicing of the dishwasher. In addition, the entire unit is quite inexpensive as it can be made of molded plastic, such as polypropylene, and each arm 23, roller 24 support, sector gear 30, and stop 36, for example, can be made from one integral molding. Similarly, each worm gear 31, stem 32, and knob, or handle, 33 can be made from a one-piece molding. In addition, the one housing part 20 not only serves as a support for the operating parts of the apparatus, but also as a closure that cooperates with the other housing part 21 to embrace portions of the corresponding side wires 16 so as to mount the entire side apparatus on these wires and, thus, on the side of the dishrack.

As can be further seen, one important feature of the adjustable dishrack supporting structure herein is that the rack is, at all times, completely supported during the adjustment process. Thus, the rack cannot be dropped or shaken inadvertently by the operator during the adjustment, and the contents of the rack will not be subject to damage from jarring as the result of abrupt movements. Movement of the rack between extremes of its travel is gradual and relatively uniform in moderate increments as the adjustment knob is manually turned by the operator.

Figure 6:
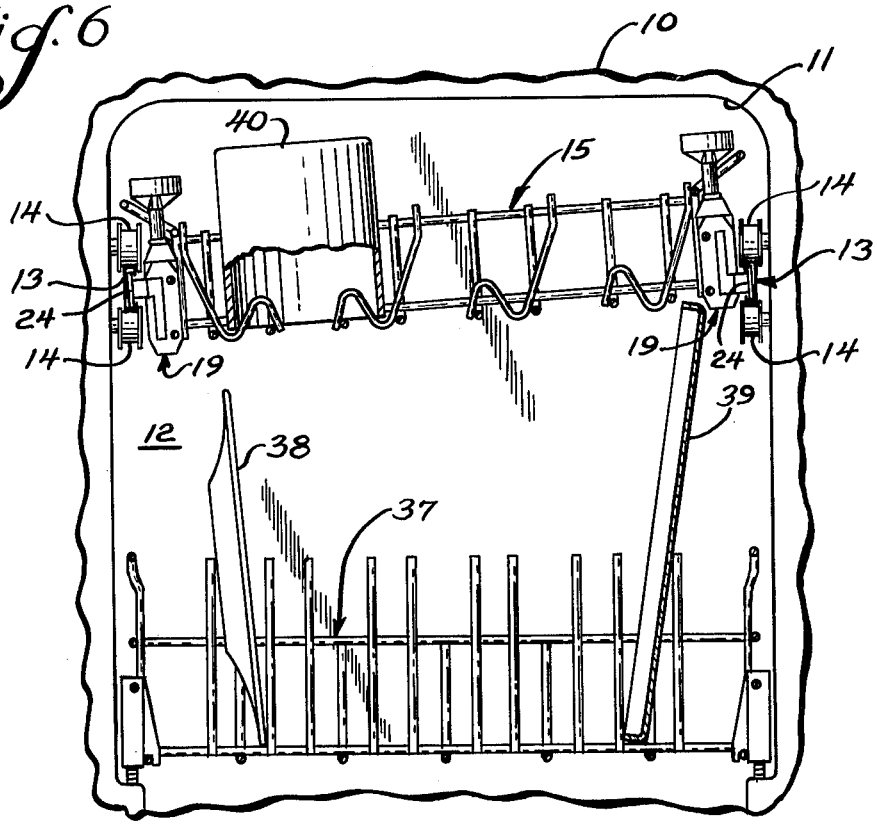
FIG. 6 is a fragmentary front elevation of the dishwasher with the dishrack in a canted disposition to accommodate a tall article on the lower dishrack at one side thereof.

With reference to FIG. 6, another highly desirable feature of the present invention is the independent adjustability of the elevation of the respective sides of the dishrack by means of the improved supporting and adjusting mechanism. As is conventional in such dishwashers, in addition to the upper dishrack 15, as discussed above, a main, or lower, dishrack 37 may be provided in the lower portion of the tub in the conventional manner. The lower dishrack is adapted to carry larger items, such as dinner plates 38 and cooking utensils, such as a cookie tin 39, as illustrated in FIG. 6. As shown therein, where the elements to be washed, such as cookie tin 39, extend upwardly from the lower rack 37 to beyond the lower portion of the upper rack 15 when the upper rack is in its lowermost position, the portion of the rack which is in overlying relationship to the relatively tall elements may be raised independently of the other portions of the rack, thereby accommodating the tall elements carried by the lower rack while yet permitting relatively tall elements, such as bowl 40, to be carried on the upper rack 15 at portions thereof remote from the upwardly adjusted portion. Thus, the present invention provides an improved adjustability in the positioning of the upper rack to conform the disposition thereof more accurately to the individual loadings of the dishwasher.

By virtue of the use of the worm gear, the adjusted position of the upper dishrack is effectively releasably locked. Additionally, the amount of canting of the upper dishrack about the fore-and-aft centerline thereof is limited by the stop members 35 and 36 to a preselected maximum canting in either direction about the centerline.

While a highly desirable feature of the present invention is the permissible canting to accommodate tall articles at one side of the dishwasher, as will be obvious to those skilled in the art, the present invention further permits distribution of such articles on the lower dishrack by permitting the elevation of the entire upper dishrack to an upper canted, or horizontal disposition as required by the article loading.

The embodiments of the invention in which an exclusive property or privilege is claimed are defined as follows:

1. In an apparatus for supporting articles in a dishwasher including an open dishrack having a pair of opposite sides comprising spaced members, rack supporting and adjusting apparatus comprising:

a pair of housings each mounted on one of said opposite sides of said dishrack;

a pair of arms extending in tandem from within each said housing and carrying spaced wheels engaging a supporting guide track that forms a part of said dishwasher;

fulcrum means within said housing for supporting each of said arms for arcuate movement thereof and thus of the said wheels, each arm having an end within the housing comprising a sector gear each lying on an arc substantially concentric with said fulcrum, said sector gears being spaced apart substantially the width of a worm gear;

a worm gear within said housing between and engaging both said sector gears for simultaneous movement thereof on rotation of said worm gear; and means mounting said worm gear within said housing for externally controlled rotational movement thereof thereby adjusting the arcuate positions of said pair of arms substantially simultaneously.

2. The apparatus of claim 1 wherein each pair of said arms are of substantially equal length and the corresponding said sector gears are of substantially equal length whereby rotation of said worm gear changes the vertical positioning of its said pair of wheels with respect to its said housing substantially equal amounts.

3. The apparatus of claim 1 wherein each said housing comprises two separable parts embracing a pair of said spaced members at a said side of the rack for supporting the dishrack on the housing and thus the dishrack on the pair of tandem wheels.

4. The apparatus of claim 1 wherein each of said sector gears includes a stop member, the resulting two stop members within each said housing being located oppositely to each other and engaging its said worm at the ends of the ranges of movement of the respective sector gears.

5. The apparatus of claim 1 wherein each said housing is in two separable parts one of which contains both said arms, sector gears and the worm gear, and the other of which contains corresponding shaped grooves for embracing the said spaced members of a side of said rack.

6. The apparatus of claim 1 wherein there are provided two of said adjustable supporting apparatus, all having identical arms, sector gears, rollers and worm gears.

7. The apparatus of claim 1 wherein each pair of said arms is of substantially equal length and the corresponding said sector gears are of substantially equal length whereby rotation of said worm gear changes the vertical positioning of its said pair of wheels with respect to said housing substantially equal amounts and wherein said housing comprises two separable parts embracing a pair of said spaced members at a said side of the rack for supporting the dishrack on the housing and thus the dishrack on a pair of tandem wheels.

8. In an apparatus for supporting articles in a dishwasher including an open dishrack having a pair of opposite sides comprising spaced wires, rack supporting and adjusting apparatus comprising:

a pair of enclosing housings each mounted on one of said opposite sides f said dishrack; a pair of arms extending in tandem from the ends of each said housing and positioned adjacent to their corresponding dishwasher side;

a supporting wheel on the end of each arm that is opposite said housing with each corresponding pair of wheels being substantially horizontally aligned and engaging a supporting guide track that forms a part of said dishwasher;

fulcrum means in each said housing for supporting each pair of said arms for arcuate movement thereof about the fulcrum and thus of the supporting wheels, each arm having an end within its housing comprising a sector gear lying on an arc that is substantially concentric with the corresponding fulcrum, said sector gears for each pair of arms being substantially coplanar in a plane substantially parallel to the adjacent dishrack side, each corresponding pair of arms being of substantially equal length and the corresponding sector gears also being of substantially equal length and radius to facilitate concurrent movement of corresponding said arms for corresponding changes in the vertical position of their said pair of wheels with respect to said dishrack substantially equal amounts;

a worm gear vertically arranged in each said housing and engaging the corresponding pair of said sector gears and being rotatably mounted for simultaneous movement of the pair of gears on rotation of their worm gear;

a stop member at one end of each said sector gear with opposite stop members on each corresponding pair of sector gears engageable with a different end of their worm to determine the range of sector gear movement; and means mounting each said worm gear on its said housing for rotational movement of the worm gear thereby adjusting the arcuate positions of its pairs of arms substantially simultaneously while maintaining the horizontal alignment of each pair of said wheels.

9. The apparatus of claim 8 wherein each said housing is in two separable parts one of which contains both said arms, sector gears and the worm gear, and the other of which contains corresponding shaped grooves for embracing the said spaced wires on a side of said rack and wherein there are provided two of said adjustable supporting apparatus, all having identical arms, sector gears, wheels and worm gears.

10. In an apparatus for supporting articles in a dishwasher including an open dishrack having a pair of opposite sides comprising spaced members, rack supporting and adjusting apparatus comprising: a pair of housings each mounted on one of said opposite sides of said dishrack; a pair of arms of substantially equal length extending in tandem from each said housing and carrying spaced wheels engaging a supporting guide track that forms a part of said dishwasher; fulcrum means in said housing for supporting each of said arms for arcuate movement thereof and thus of the said wheels, each arm having an end within the housing comprising a sector gear each lying on an arc substantially concentric with said fulcrum; a worm gear in said housing between and engaging both said sector gears for simultaneous movement thereof on rotaion of said worm gear; and means mounting said worm gear on said housing for externally controlled rotational movement thereof thereby adjusting the arcuate positions of said pairs of arms substantially simultaneously, said sector gears being of substantially equal length whereby rotation of said worm gear changes the vertical positoning of its said pair of wheels with respect to said housing substantially equal amounts, said housing comprising two separable parts embracing a pair of said spaced members at a said side of the rack for supporting the dishrack on the housing and thus the dishrack on a pair of corresponding said tandem wheels, each of said sector gears including a stop member, the resulting two stop members within each said housing being located oppositely to each other and engaging their said worm at the ends of the ranges of movement of the respective sector gears and each said housing being in two separable parts one of which contains both said arms, sector gears and the worm gear, and the other of which contains corresponding shaped grooves for embracing the said spaced members of a side of said rack.

* * * * *